US008235847B1

(12) United States Patent
Bittner

(10) Patent No.: US 8,235,847 B1
(45) Date of Patent: Aug. 7, 2012

(54) RACQUET FRAMES HAVING A REPLACEABLE PROTECTIVE LAYER

(75) Inventor: Darjon R. Bittner, Cedar Hill, TX (US)

(73) Assignee: 3 Racquet Technology LLC, Cedar Hill, TX (US)

( * ) Notice: Subject to any disclaimer, the term of this patent is extended or adjusted under 35 U.S.C. 154(b) by 0 days.

(21) Appl. No.: 12/891,702

(22) Filed: Sep. 27, 2010

Related U.S. Application Data

(60) Provisional application No. 61/246,153, filed on Sep. 27, 2009.

(51) Int. Cl.
*A63B 49/14* (2006.01)

(52) U.S. Cl. ..... 473/548; 473/553; 473/537

(58) Field of Classification Search ..... 473/524, 473/537, 553, 547, 548
See application file for complete search history.

(56) References Cited

U.S. PATENT DOCUMENTS

| | | | | |
|---|---|---|---|---|
| 3,048,399 | A * | 8/1962 | Breitbach | 473/457 |
| 4,019,736 | A * | 4/1977 | Lehew | 473/548 |
| 4,200,285 | A * | 4/1980 | Petitti, Jr. | 473/437 |
| 4,320,900 | A * | 3/1982 | Blackburne | 473/533 |
| 4,496,152 | A * | 1/1985 | Mott | 473/539 |
| 4,779,869 | A * | 10/1988 | Spann | 473/537 |
| 5,092,593 | A * | 3/1992 | Williams et al. | 473/537 |
| 5,098,099 | A * | 3/1992 | Liu | 473/548 |
| 6,088,947 | A * | 7/2000 | Suzue et al. | 43/18.1 R |
| 7,407,457 | B2 * | 8/2008 | Dollins | 473/548 |
| 7,946,937 | B2 * | 5/2011 | Searle | 473/521 |
| 2005/0192129 | A1 * | 9/2005 | Kuwabara | 473/520 |
| 2009/0291784 | A1 * | 11/2009 | Searle | 473/521 |

* cited by examiner

*Primary Examiner* — Raleigh W. Chiu

(57) ABSTRACT

A racquet frame including a light-weight, semi-permanent protective layer covering portions of the racquet frame is described. The semi-permanent protective layer may be applied to significant portions of the racquet frame without substantially changing performance features of the racquet frame. The semi-permanent protective layer reduces cosmetic damage to the frame of the racquet and may be replaced from time to time as needed. Further, the protective layer can be graphically enhanced providing a level of graphical customization to the racquet frame.

15 Claims, 2 Drawing Sheets

RACQUET FRAMES HAVING A REPLACEABLE PROTECTIVE LAYER

CROSS-REFERENCE TO RELATED APPLICATIONS

This application claims priority to U.S. Provisional Patent Application No. 61/246,153, filed Sep. 27, 2009, which is herein specifically incorporated by reference in its entirety.

FIELD OF THE INVENTION

The present invention is directed to racquets with a semi-permanent and replaceable protective layer that can be graphically enhanced.

BACKGROUND OF THE INVENTION

Racquets are used in sports such as tennis, squash, badminton, and racquetball. The racquets are produced and sold by the racquet manufacturer to the consumer. Generally, for a given model of racquet, the racquet frame will come in a particular color scheme with a set of graphics designed by the manufacture. The racquet frames are typically painted and the graphics are often a set of decals applied to different portions of the frame. The decals are usually very thin and only as large as the graphic requires. These graphics or decals are permanent features of the racquet in that they cannot be removed without significant effort such as sanding or stripping the graphics off of the frame of the racquet. The consumer typically has no control over the looks of the racquet frame from the manufacturer including the color of the racquet and the looks and location of the graphics. If the consumer wanted the racquet frame in a different color or with different graphics, the consumer would typically have to sand, strip or cover the current color and graphics of the racquet frame and repaint the racquet frame with the desired colors and graphics. This process can be expensive and time consuming.

During routine play, the racquet frame of the racquets experience a certain amount of wear and tear, including scratches, scrapes, and chips and other damage. This type of cosmetic damage may occur when a racquet hits or scrapes the court, floor, or walls during play. To reduce cosmetic damage to the frame, many racquets include a bumper guard at the end of the head of the racquet. The bumper guard is typically a relatively bulky plastic piece that only covers a relatively small portion of the frame at the end of the head of the racquet. The bumper guard only provides protection for the portion of the frame at the end of the head of the racquet covered by the bumper guard. Chips, scrapes, scratches, and cracks can occur at all portions of the racquet frame and not just at the end of the head of the racquet. It is not practical to extend the bumper guard over most of the racquet frame as this will add considerable weight to the racquet and significantly change the performance features such as the balance point and aerodynamic features of the frame. The paint and decals from the manufacturer provides very little protection for the frame from cosmetic damage. Thus, over time, racquet frames show significant wear and tear such as chips, scratches, and/or cracks in the paint of the racquet as well as damage to the graphics or decals. For most consumers, this cosmetic damage is not repaired and the racquet frame will continue to show the damage for the life of the racquet. If the consumer wanted to repair the damage to the racquet frame, the damaged racquet frame would have to be repainted or touched up including replacing graphics if necessary. Since this in not typically done, the looks of the racquet will continue to deteriorate with continued use of the racquet.

BRIEF SUMMARY OF THE INVENTION

Certain embodiments of the invention are directed to a racquet frame that comprises a light-weight, semi-permanent protective layer covering portions of the racquet frame. The semi-permanent protective layer may be applied to significant portions of the racquet frame without substantially changing performance features of the racquet frame. The semi-permanent protective layer reduces cosmetic damage to the frame of the racquet and may be replaced from time to time as needed. Further, the protective layer can be graphically enhanced providing a level of graphical customization to the racquet frame.

Some embodiments may include, a racquet comprising a racquet frame having exterior surfaces and a replaceable protective layer covering at least a portion of the exterior surfaces of the racquet frame, wherein the replaceable protective layer is a film that conforms to the shape of the racquet frame.

Other embodiments may include a racquet comprising a racquet frame having exterior surfaces of the racquet frame and a replaceable protective layer having graphics, wherein the replaceable protective layer is a polymer film having a thickness ranging from about 1 mil to about 5 mils that conforms to the shape of the racquet frame and covers substantially all of the exterior surfaces of the racquet frame, and wherein the replaceable protective layer is adhered to the racquet frame with an adhesive that provides for the semi-permanent bonding of the replaceable protective layer to the exterior surfaces of the racquet frame.

DETAILED DESCRIPTION OF EMBODIMENTS OF THE INVENTION

Embodiments of the present invention are directed to a racquet frame having a semi-permanent or replaceable protective layer covering portions of the racquet frame to reduce cosmetic damage to the frame. Further, in certain embodiments, the protective layer may include color and graphical elements to enhance the appearance of the racquet.

As used herein, "racquet," either in its singular or plural form, includes any type of racquet that has a racquet frame supporting a string bed including, but not limited to, tennis racquets, racquetball racquets, badminton racquets, real tennis racquets, and squash racquets. The racquet frame may be described as a frame with head in the form of an open hoop, a handle, and a throat bridging the head and handle of the racquet frame. The head of the racquet frame is adapted to support strings of a string bed. Typically the head will include or define a plurality of holes for supporting strings of the string bed. In some embodiments, the throat and/or handle may support one or more strings of the string bed. The number, size and shape of holes in the frame varies widely and depends upon the design of the racquet including the number of main strings and cross-strings, any shared holes, and other design considerations.

Figure 1:
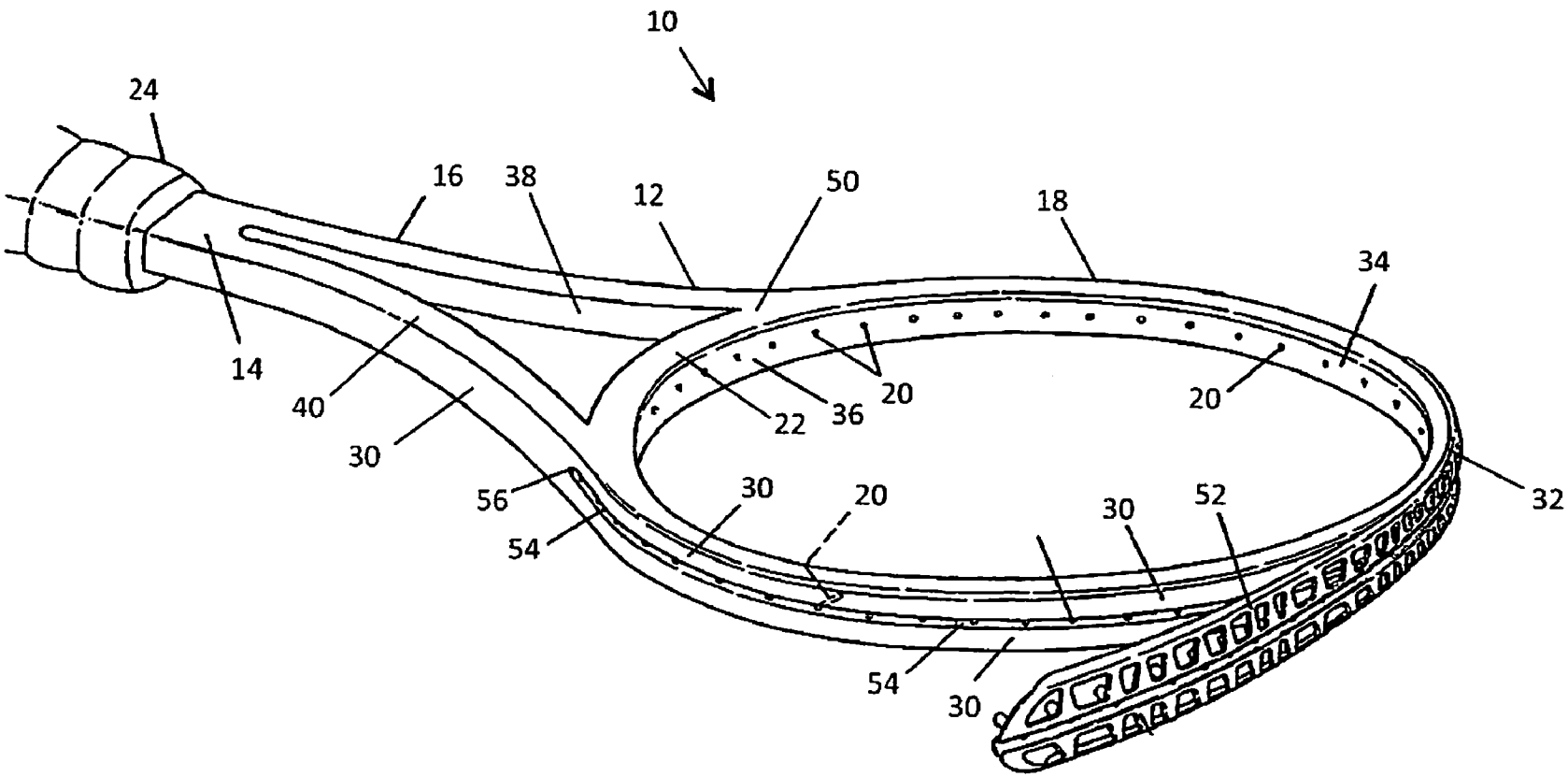
FIG. 1 is a perspective view of a racquet according to an embodiment of the invention during assembly.

With reference to FIG. 1 there is illustrated a racquet 10 in accordance with an embodiment of the invention shown during assembly. The racquet 10 illustrated in FIG. 1 is directed to an embodiment of a racquet used for tennis. While the following discussion refers to the racquet in FIG. 1, the concepts described below are transferrable to other racquets including other tennis racquets, racquetball racquets, squash racquets, or badminton racquets.

The racquet 10 includes a racquet frame 12 having a handle 14, throat 16, and head 18. The head 18 is in the form of an open hoop and is adapted to support strings of a string bed (not shown). The head 18 may include a plurality of holes, representative holes being designated with the reference numeral 20 for supporting strings of the string bed. The number of holes 20 in the racquet frame may vary widely and depends upon the design of the racquet including the number of main strings and cross-strings, any shared holes, and other design considerations.

The head 18 transitions into the throat 16 of the racquet frame. The size, shape and configuration of the throat 16 can vary widely. In some embodiments, the racquet throat 16 may include a throat bridge 22. In some embodiments the throat 16 or throat bridge 22 may include or define one or more holes for supporting strings making up the string bed. In some embodiments, the racquet does not include a throat bridge and holes for supporting the strings of the string bed may be positioned near the throat of the racquet. The throat of a tennis racquet and squash racquet is generally longer or larger than the throat of a racquetball racquet. Some racquetball racquets do not have a throat bridge that separates the head from the throat of the racquet. The throat 16 of the racquet bridges the head 18 of the racquet frame 12 with the handle 14. The handle 14 and head 18 are at generally opposite ends of the racquet frame. The handle 14 is often covered with a grip 24.

The racquet frame 12 has a plurality of exterior surfaces. As used herein "exterior surfaces" are the outside and generally accessible surfaces of the racquet frame. In some embodiments, the exterior surfaces of the racquet frame may include, but are not limited to, the surfaces of the racquet frame not covered by a grip on the handle of the racquet frame.

Referring to FIG. 1, some of the exterior surfaces, depending upon the shape and configuration of the racquet frame 12, may include an outer side surface 30, an inner head surface 34, face surfaces 40, and inner throat surfaces 38. The outer side surface 30 generally tracks the side of the racquet frame along the length of the racquet frame and emanates from or begins near the handle 14 and extends around the head 18 near the end 32 of the head of the racquet frame. The outer side 30 surfaces generally face away from where the string bed of the racquet would be located. The racquet frame 12 also includes an inner head surface 34 that, in certain embodiments, generally tracks the inside perimeter of the head 18. In some embodiments, the inner head surface 34 generally faces away from or opposes portions of the outer side surface 30 and generally faces towards the string bed. In further embodiments, the inner head surface 34 may include surfaces 36 of the throat bridge 22 that form a portion of the hoop of the head 18 of the racquet frame 12. In some embodiments, when a throat bridge 22 is used between the head 18 and the throat 16 of the racquet, the racquet frame 12 will include inner throat surfaces 38 around an interior region of the throat 16. The racquet frame 12 also includes face surfaces 40 generally connecting the inner head surfaces 34 and with the outer side surfaces 30 of the racquet frame. Further, in some embodiments, the face surfaces 40 may connect outer side surfaces 30 with inner throat surfaces 38.

According to certain embodiments of the invention, at least portions of the exterior surfaces of the racquet frame are covered with a semi-permanent and replaceable protective layer. The protective layer is a thin, lightweight, and flexible layer that conforms to the shape of the racquet frame. The protective layer is a semi-permanent layer that can be removed and replaced when desired. While the protective layer is semi-permanent and removable or replaceable, the protective layer looks and feels like a permanent and integral part of the racquet frame.

With reference to FIG. 1, a protective layer 50 covers substantially all of the exterior surfaces of the racquet frame 12 including the outer side surfaces 30, an inner head surface 34, face surfaces 40, and inner throat surfaces 38. In some embodiments, the protective layer comprises a protective film and an adhesive. The protective film is preferable as thin and lightweight as possible yet is resilient enough to resist or reduce cosmetic damage to the racquet frame. In certain embodiments, the protective film is flexible, pliable, and stretchable such that the film can conform to various shapes, indentations curvatures, and other features of the racquet frame. In some embodiments, the thickness of the protective film may range in thickness from about 1 mil to about 10 mils, where 1 mil equals $1\times10^{-3}$ inch. In other embodiments the thickness of the protective film may range from about 1 mil to about 5 mils, and in still other embodiments, from about 2 mils to about 4 mils. The protective film may be a polymeric or resinous film, a metal film, or a fiber reinforced polymeric film. In some embodiments, the protective film may be a vinyl film.

The adhesive of the protective layer provides for the semi-permanent bonding of the protective film to the surface of the racquet frame. In some embodiments, the adhesive may be a pressure sensitive or heat sensitive adhesive. The adhesive is not particularly limited but should allow for the removal of the protective film. In some embodiments, the protective film may be removed by the application of physical force, heat or appropriate chemicals depending upon the characteristics of the adhesive being used.

In some embodiments, the protective film may be clear. In other embodiments, the protective film may be colored. If desired, graphics may be applied to the protective film. The graphics may be applied to the protective film by inkjet printing, electrostatic imaging, screen printing or other suitable imaging or printing techniques. The protective film should be receptive to the type of printing or imaging being employed. In certain embodiments, a graphics design may be created and applied to the protective film prior to applying the protective film to the racquet frame. The graphics design may be designed with the aid of a computer and applied to the protective film using imaging techniques described above.

A suitable protective film and adhesive combination that may be used to form the protective layer and graphically customized utilizing inkjet printing techniques includes, but is not limited to, Controltac™ Wrap Film with Comply™ v3 commercially available from 3M Corporation. In embodiments where graphics are applied to the protective film, an overlaminate film or coating may be applied to the protective film to protect the graphics on the protective film.

The protective film is sized to cover the desired surface or surfaces for the particular racquet. The protective film is then applied to the racquet frame in accordance with the adhesive being used and forms the protective layer. In some embodiments, one or more sections of the protective film may be used to cover desired areas of the racquet frame. In further embodiments, at least two sections may be used to cover exterior surfaces of the racquet frame. It is generally easier to apply the protective film to the racquet frame without the string bed, bumper guard, or grommets present.

Once the protective film and adhesive are applied to form the protective layer, the strings, the bumper guard, and any grommets may be installed on the racquet frame. The protective film is preferably designed and installed such that any seams for the protective film are placed at regions of the frame where the seams will be less noticeable. Some suggested seam locations may include, but are not limited to, under grommet strips on the exterior of the frame, along hard edges of the frame, under the bumper guard, portions of the frame where they will be less noticeable. In FIG. 1, the racquet 10 includes grommets 54 along the side of the racquet frame. Seams for the protective layer 50 may be matched or hidden under the grommets 54 that lay in a channel 56 of the racquet frame.

In some embodiments, the protective layer covers substantially all of the exterior surfaces of the racquet frame. In other embodiments the protective layer covers from about 40% to about 80% of the exterior surfaces of the racquet frame. In further embodiments, the protective layer covers at least 50% of the exterior surfaces of the racquet frame. In certain embodiments the protective layer may cover selected exterior surfaces individually, together, or in combination with one or more exterior surfaces. Embodiments may include a protective layer covering substantially all of the exterior surfaces of the head and throat of the racquet frame. By covering substantially all of the surfaces of the head and throat, there will be very few portions of the head that will be exposed and susceptible to cosmetic damage. In other embodiments, the protective layer covers at least 40% of the surfaces of the head and throat of the racquet frame. In further embodiments, the protective layer may cover at least 50% of the surfaces of the head and throat of the racquet frame. In still further embodiments, the protective layer may cover at least 70% of the surfaces of the head and throat of the racquet frame.

In other embodiments, the protective layer may cover substantially all of the face surfaces and outer side surfaces of the racquet frame. In other embodiments, the protective layer may cover at least 40% of the face surfaces and outer side surfaces of the racquet frame. In further embodiments, the protective layer may cover at least 50% of the face surfaces and outer side surfaces of the racquet frame. In still further embodiments, the protective layer may cover at least 70% of the face surfaces and outer side surfaces of the racquet frame.

In embodiments where portions of the head of the racquet frame are not covered by the protective layer, these are preferably portions of the racquet frame that are less likely to experience damage. For example, with reference to FIG. 1, some racquets include a bumper guard 52 at the end 32 of the head 18 of the racquet frame 12. The bumper guard 52 is typically a thick piece of plastic that is secured to the end of the frame with the strings of the string bed. Since the bumper guard is covering the end of the head of the racquet, the protective layer may optionally cover the surfaces of the head where the bumper guard is located.

As discussed above, the protective layer may by graphically customized. By graphically customizing the protective layer, racquet may be designed for a particular theme such as a particular event or program. Further, customized protective layers may be designed for teams, clubs, and organizations. The protective layer provides the benefits of protecting the racquet frame from cosmetic damage and creating custom designed graphics with the benefit of being able to replace the protective layer when the protective layer becomes damaged or when a different theme or set of graphics is desired.

Figure 2:
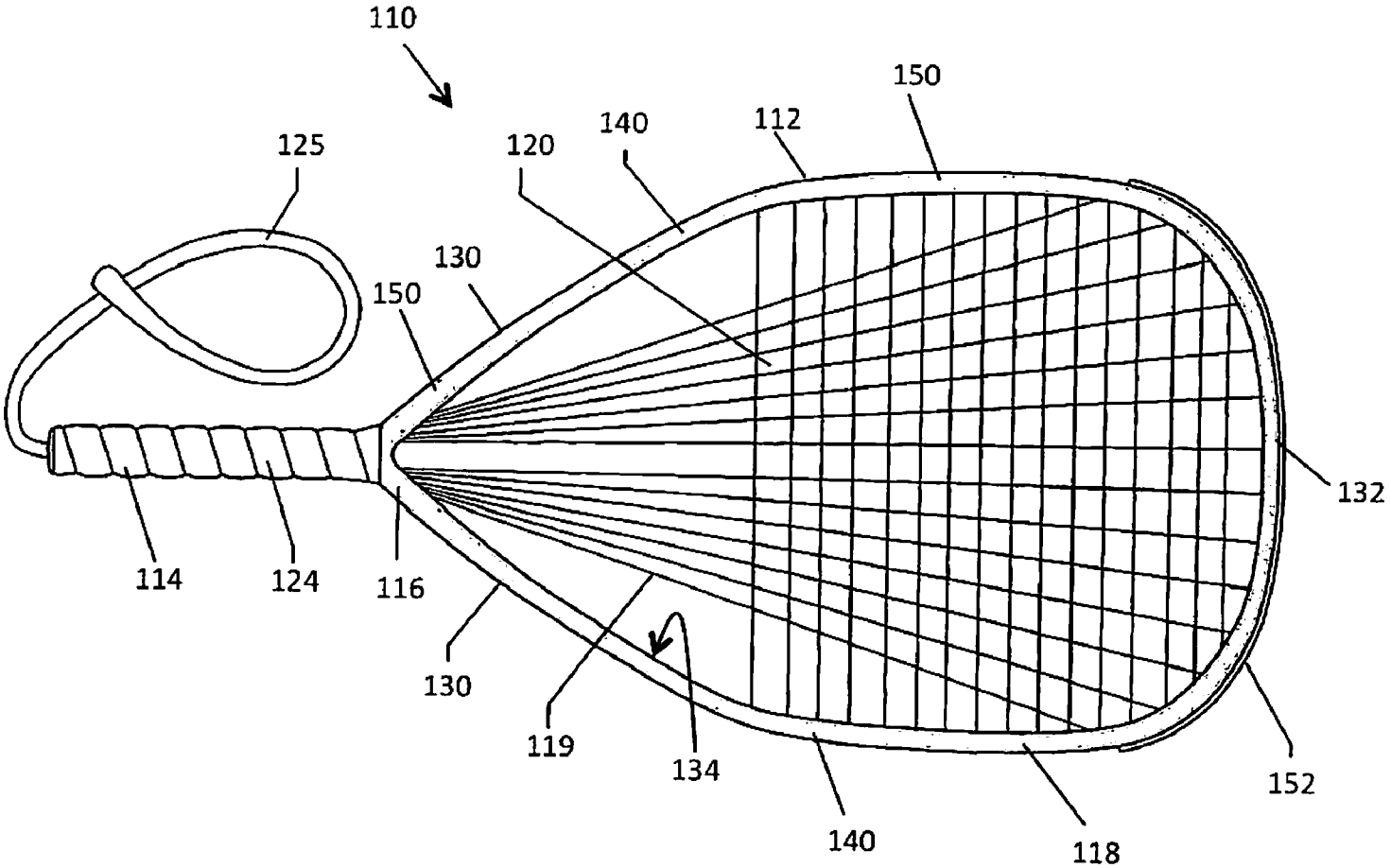
FIG. 2 is a plan view of a racquet according to another embodiment of the invention.

Turning to FIG. 2 there is illustrated a racquet 110 in accordance with an embodiment of the invention. The racquet 110 is illustrative of the type of racquet used in racquetball. The racquet 110 includes a racquet frame 112 having a handle 114, throat 116, and head 118. The head 118 is in the form of an open hoop and is adapted to support strings 119 of the string bed. The head 118 transitions into the throat 116 of the racquet frame. The size, shape and configuration of the throat 116 can vary widely. The throat 116 of the racquet bridges the head 118 of the racquet frame 112 with the handle 114. The handle 114 and head 118 are at generally opposite ends of the racquet frame. The handle 114 is often covered with a grip 124. A tether 125 is shown attached to the handle 114 of the racquet frame 112 and the racquet may include a bumper guard 152.

The racquet frame 112 includes exterior surfaces such as outer side surfaces 130 that emanates from the handle and extends around the head 118 to the end 132 of the head of the racquet frame. The outer side 130 surfaces generally face away from the string bed. The racquet frame 112 also includes an inner head surface 134 that, in certain embodiments, generally tracks the inside perimeter of the head 118. In some embodiments, the inner head surface 134 generally faces away from or opposes portions of the outer side surface 130 and generally faces towards the string bed. The racquet frame 112 also includes face surfaces 140 generally connecting the inner head surfaces 134 and with the outer side surfaces 130 of the racquet frame.

According to certain embodiments, a protective layer 150 covers one or more exterior surfaces of the racquet frame 112. The protective layer 150 is thin, lightweight and conforms to the shape of the frame 112 of the racquet 110. The protective layer 150 is a semi-permanent layer that can be removed and replaced when desired. The features of the protective layer discussed above are applicable to the embodiment illustrated in FIG. 2. The protective layer 150 may be made from the same materials discussed above with respect to the protective layer. While the protective layer is semi-permanent and removable or replaceable, the protective layer looks and feels like a permanent and integral part of the racquet frame.

While embodiments of the invention have been described in detail above, the invention is broadly applicable to many applications and limited only by the claims.

What is claimed is:

1. A racquet comprising:

a racquet frame comprising exterior surfaces of the racquet frame; and a replaceable protective layer covering at least a portion of the exterior surfaces of the racquet frame, wherein the replaceable protective layer is a film that conforms to the shape of the racquet frame, wherein the replaceable protective layer is adhered to the exterior surfaces of the racquet frame by a pressure sensitive or heat sensitive adhesive.

2. The racquet of claim 1, wherein the replaceable protective layer covers at least 50% of the exterior surfaces of the racquet frame.

3. The racquet of claim 1, wherein the replaceable protective layer covers from about 40% to about 80% of the exterior surfaces of the racquet frame.

4. The racquet of claim 1, wherein the replaceable protective layer covers substantially all of the exterior surfaces of the racquet frame.

5. The racquet of claim 1, wherein the racquet frames comprises a head and a throat, and wherein the replaceable protective layer covers at least 40% of the surfaces of the head and throat of the racquet frame.

6. The racquet of claim 5, wherein the replaceable protective layer covers at least 50% of the surfaces of the head and throat of the racquet frame.

7. The racquet of claim 5, wherein the replaceable protective layer covers at least 70% of the surfaces of the head and throat of the racquet frame.

8. The racquet of claim 1, wherein the exterior surfaces comprise face surfaces and outer side surfaces of the racquet frame, and wherein the replaceable protective layer covers at least 40% of the face surfaces and outer side surfaces of the racquet frame.

9. The racquet of claim 8, wherein the replaceable protective layer covers at least 50% of the face surfaces and outer side surfaces of the racquet frame.

10. The racquet of claim 8, wherein the replaceable protective layer covers at least 70% of the face surfaces and outer side surfaces of the racquet frame.

11. The racquet of claim 1, wherein the replaceable protective layer comprises graphics.

12. The racquet of claim 1, wherein the replaceable protective layer comprises at least two sections.

13. The racquet of claim 1, wherein the replaceable protective layer is a polymer film having a thickness ranging from about 1 mil to about 5 mils.

14. The racquet of claim 1, wherein the racquet frame is a tennis racquet frame, racquetball racquet frame, or a squash racquet frame.

15. A racquet comprising:

a racquet frame comprising exterior surfaces of the racquet frame; and a replaceable protective layer having graphics, wherein the replaceable protective layer is a polymer film having a thickness ranging from about 1 mil to about 5 mils that conforms to the shape of the racquet frame and covers substantially all of the exterior surfaces of the racquet frame, and wherein the replaceable protective layer is adhered to the racquet frame with an adhesive that provides for the semi-permanent bonding of the replaceable protective layer to the exterior surfaces of the racquet frame.

* * * * *